US006192662B1

(12) United States Patent
Rimondi et al.

(10) Patent No.: US 6,192,662 B1
(45) Date of Patent: Feb. 27, 2001

(54) DEVICE FOR POSITIONING AND CUTTING THE FILM IN THE PACKAGING STATION OF A MACHINE FOR PACKAGING WITH STRETCHABLE FILM

(75) Inventors: Renato Rimondi, Bazzano; Angelo Cappi, Vignola, both of (IT)

(73) Assignee: A.W.A.X. Progettazione E Ricerca S.R.L., Vignola (IT)

( * ) Notice: Subject to any disclaimer, the term of this patent is extended or adjusted under 35 U.S.C. 154(b) by 0 days.

(21) Appl. No.: 09/180,526

(22) PCT Filed: Jul. 29, 1997

(86) PCT No.: PCT/EP97/04121

§ 371 Date: Nov. 9, 1998

§ 102(e) Date: Nov. 9, 1998

(87) PCT Pub. No.: WO98/05557

PCT Pub. Date: Feb. 12, 1998

(30) Foreign Application Priority Data

Aug. 2, 1996 (IT) ..... BO96A0426

(51) Int. Cl.[7] ..... B65B 11/18; B65B 53/00
(52) U.S. Cl. ..... 53/556; 53/228; 53/389.3
(58) Field of Search ..... 53/556, 389.3, 53/228, 221

(56) References Cited

U.S. PATENT DOCUMENTS 2,273,961 * 2/1942 Hoppe ..... 53/389.3 X
4,223,511 * 9/1980 Black ..... 53/389.3
4,583,348 * 4/1986 Treiber ..... 53/556 X
5,115,620 * 5/1992 Takamura ..... 53/556

FOREIGN PATENT DOCUMENTS

619227 * 10/1994 (EP) .

* cited by examiner

*Primary Examiner*—Linda Johnson
(74) *Attorney, Agent, or Firm*—Larson & Taylor

(57) ABSTRACT

The blade (12) which is to make the transverse cut of the film in the product packaging station is fixed in the lower part of the grooved section (11) which forms part of the front folder (9) of the packaging machine and has its cutting edge facing downwards. The film to be cut (102) is raised against this blade by a parallel grooved bar (13) with rounded and preferably staggered edges, which in an intermediate phase before its own working travel is also used to raise the section of the film which will have to be cut subsequently, to dispose the film in the correct position for gripping by the lateral grippers (6) of the packaging machine. The said film raising bar is preferably driven by means of a link block, by and electric motor (22) with electronic rotation speed and phase control, controlled by the processor of the packaging machine.

4 Claims, 2 Drawing Sheets

DEVICE FOR POSITIONING AND CUTTING THE FILM IN THE PACKAGING STATION OF A MACHINE FOR PACKAGING WITH STRETCHABLE FILM

DESCRIPTION

The invention relates to constructional and functional improvements in the means which position and cut the film in the packaging station of a machine for packaging with stretchable film, particularly in a packaging machine of the type described in EP-A-0 569 615 and EP-A-0 619 227 (or U.S. Pat. No. 5,595,042), to which the most ample reference is made. This machine is provided with a fixed dispenser shaped like a comb, which retains the leading edge of the film unwound from a reel and comprises a first gripper parallel to the dispenser, also in the shape of a comb, which when commanded grips the leading edge of the film and moves away from the dispenser to extend horizontally in the packaging station a section of film whose length is suitable for the dimensions of the product to be packaged. This gripper can oscillate on a parallel axle and is designed in such a way that during the travel away from the dispenser it is raised by a correct amount and is carried substantially at the same height as a pair of lateral grippers which in the next phase are to be able to grip the lateral flaps of the section of film positioned in the packaging station, to spread this film transversely and then fold it under the product. Since the section of film positioned in the packaging station by the said moving feed gripper would have a diagonal disposition owing to the different heights of the said gripper and the dispenser, so that it would not be possible for the film to be gripped by the lateral grippers, means which are provided immediately after the dispenser are raised at the correct time to raise the film and bring it into the substantially horizontal position necessary for use.

In this machine, the separation of the section of packaging film from the dispenser, when the product has been substantially packaged and is about to leave the packaging station, is made to be carried out by a serrated blade, which is normally disposed at a lower height than that of the film dispenser and has its teeth facing upwards, and which is raised, on command, by suitable means to cut the film transversely, the elevation travel of the blade being protected by a fixed inverted "U" section in which the said blade is inserted at the end of the elevation travel.

This solution has been found to be inappropriate, unreliable and unsafe for those carrying out the maintenance of the machine, since the blade is unshielded. A first object of the invention is to overcome this problem with the following solution. The blade which is to make the transverse cut of the film is fixed inside the said grooved and fixed section, in a median position, and orientated downwards, and the film is raised against this blade by a grooved bar, with rounded edges, which in an intermediate phase of its working travel is also used to raise the portion of the section of film disposed next to the dispenser, to position the film correctly in the packaging station for gripping by the lateral grippers. With this solution, it becomes unnecessary to use special means for the said phase of initial positioning of the film in the packaging station, with advantages of simplicity in the construction of the packaging machine.

Further characteristics of the invention and the advantages derived therefrom will be evident from the following description of a preferred embodiment thereof, illustrated purely by way of example and without restriction by the figures on the two attached sheets of drawings, in which FIG. 1 is a side elevation in partial section of the packaging station of the packaging machine provided with the device in question, in the rest position;

Figure 1:
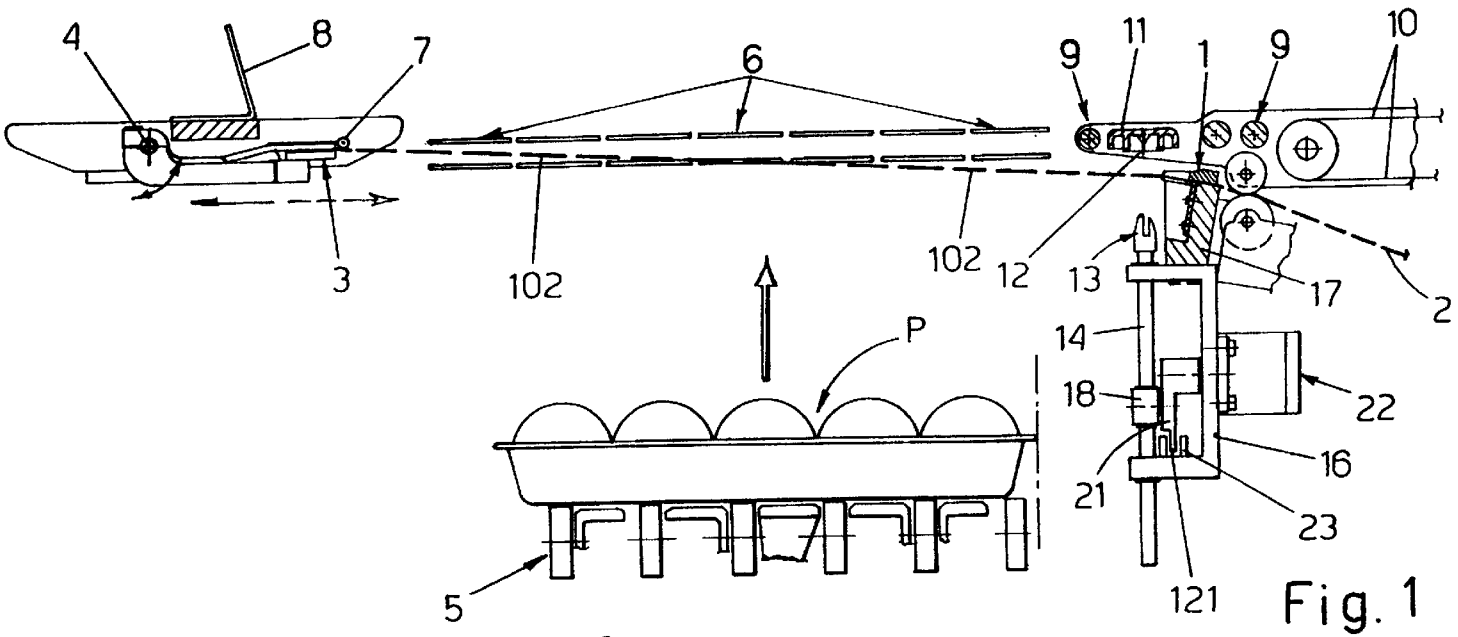
Figure 3:
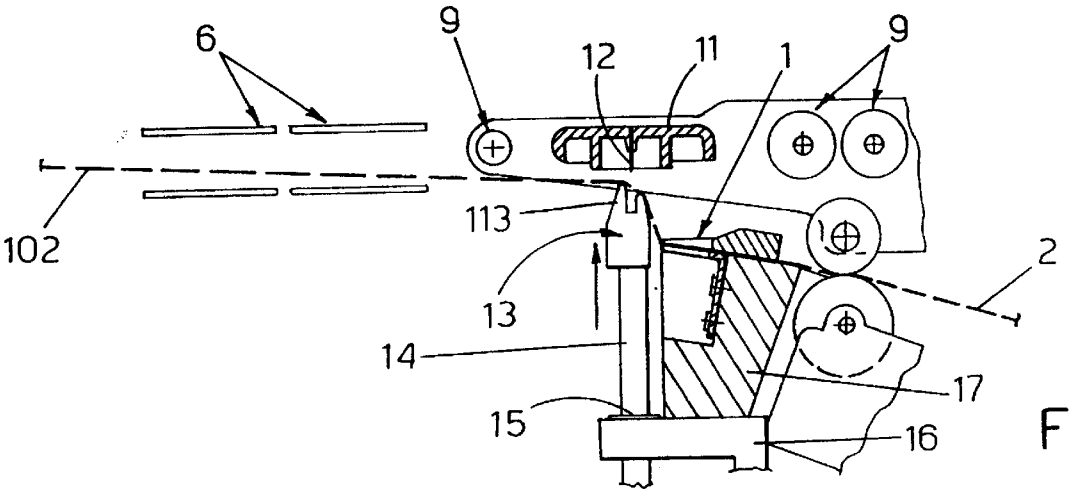
FIGS. 3 and 4 show the device from the side, with parts in section, in the intermediate film raising position and in the maximum film raising and cutting position respectively.
Figure 2:
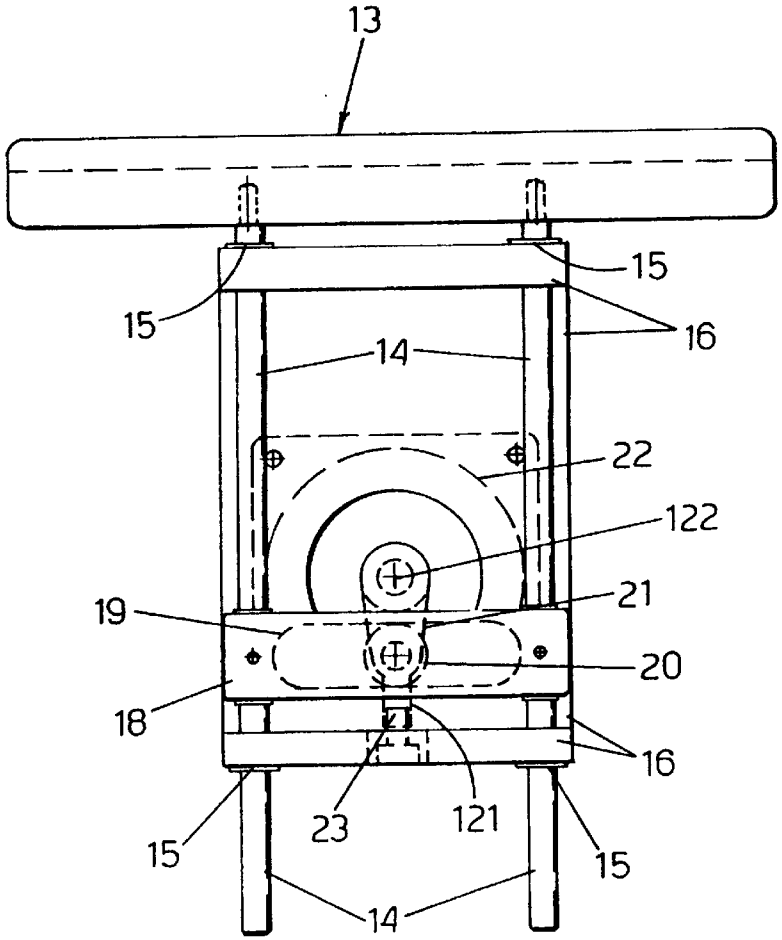
FIG. 2 is a front elevation of the film raising device, in the rest position.
Figure 4:
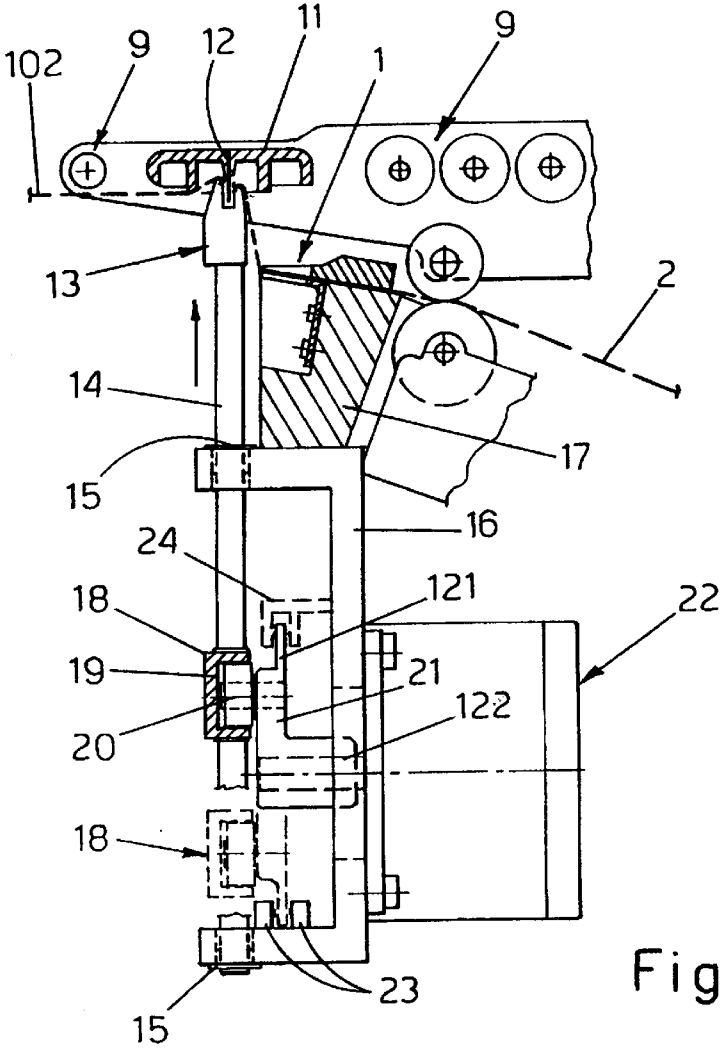

In FIG. 1, the number 1 indicates the gripper dispenser which feeds the film 2, which interacts at the correct time with the gripper 3 which can oscillate on the corresponding pivot 4 and which is driven with a movement towards and away from the dispenser, to spread in the packaging station, above the product P to be packaged, a section of film 102 whose length is proportional to the dimensions of the said product fed to the elevator 5. The number 6 indicates one of the lateral grippers designed to grip the lateral flaps of the film and to stretch it transversely, while the product P is raised against the film at the correct time by the elevator 5 and the said lateral grippers relax the transverse tension and approach each other to stretch the lateral flaps of the film under the product and enter into the support of the said product, while the elevator 5 returns to the rest position. The numbers 7 and 8 indicate, respectively, the rear folder and the pusher, which after the intervention of the lateral grippers 6 proceed to fold the rear flap of the film under the product and push the said product on to the front folder 9 which folds under the product the front flap of the film 102 which is cut at the correct time by the suitable means, separated from the dispenser 1 and transferred on to the powered removal conveyor 10 which also heat-welds the superimposed flaps of the package. In FIGS. 1, 3 and 4 it will be seen that, according to the invention, in the intermediate part of the front folder 9 there is provided a grooved section 11, which has its convex part facing upwards so that it does not obstruct the advance of the packaged product, and has its ends fixed to the frame of the machine. In the intermediate and lower part of the section 11 there is fixed the cutting blade 12, with its serrated cutting profile facing downwards. Opposite and parallel to the blade 12 there is provided a bar 13 with a grooved profile, with its upper edges rounded and preferably disposed at different heights, with a greater elevation of the edge 113 facing the gripper 3 (see below). The bar 13, as also illustrated in FIG. 2, is fixed with a symmetrical disposition on the upper end of a pair of vertical bars 14 slidable in guide housings 15 formed in the horizontal arms of a support 16 with a forked profile, fixed to the cross-piece 17 which carries the film dispenser 1. When the device is at rest, as shown in FIG. 1, the bar 13 is at a height suitably lower than that of the dispenser 1 and is at a short distance from the upper arm of the support 16, while a cross-piece 18 fixed to the bars 14 is disposed at a short distance from the lower arm of this support. The cross-piece 18 has a longitudinal straight groove 19 which is open towards the support 16 and is engaged by the roller 20 integral with the end of a crank 21 keyed to the shaft 122 of a geared motor or directly to an electric motor 22 which is fixed on the back of the support 16 and is preferably of the type with electronic speed and phase control, for example a stepping motor, designed to be controlled by the processor of the packaging machine. The shaft 122 of the motor is in a position equidistant from the bars 14 (FIG. 2). It is evident that the crank-roller-slot system 21-20-19 forms a kind of link block which can convert the rotation of the electric motor 22 into a reciprocating movement of raising and lowering of the bar 13.

When the device is at rest, the crank 21 points downwards and an extension 121 of the crank beyond the axis of the roller 20 interacts with a sensor 23, of the optoelectronic type for example, fixed to the lower arm of the support 16. This sensor is electronically connected to the same processor which controls the electric motor 22.

The device designed in this way operates as follows. After the gripper 3 has stretched a section of film 102 in the packaging station, the electric motor 22 is activated to make its shaft execute a rotation of less than 180°, for example approximately 120–135°, after which the said motor stops. As a result of this rotation, the bar 13 is raised as shown in FIG. 3 until it arrives close to the blade 12 but without interference of the film with the blade. The section of film raised by the bar 13 and retained at the other end by the gripper 3 is thus in the ideal condition to be gripped laterally by the lateral grippers 6. The bar 13 remains in this position of partial raising throughout the product packaging cycle, at the end of which the motor 22 is commanded to complete the upward rotation of the crank 21 and then to return with the crank to the low position of the start of the cycle. When the crank 21 is orientated vertically upwards, as shown in FIG. 4, the bar 13 brings the film to interact with the blade 12 and to be cut.

FIGS. 3 and 4 show how the particular profile of the bar 13 prevents the film from being subjected to undesired tension during the interaction with this bar.

In FIG. 4, the number 24 indicates a sensor, shown in broken lines, which may if necessary be provided to detect the position of partial raising and if necessary also of total raising of the said bar 13.

What is claimed is:

1. A machine for packaging articles with a stretchable film comprising:

a dispenser of a stretchable film located at a packaging station;

a front gripper which grips a leading edge of the film dispensed from said dispenser and which is moved forwardly to extend a section of the film horizontally and at a disposed angle in the packaging station;

respective lateral grippers which grip respective lateral sides of the film section in the packaging station, said grippers being positioned to grip the film section where the film section is extended at a second angle different from the disposed angle; and a cutting device which separates the film section from a remainder of the film in the dispenser in the packaging station, said cutting device including a) a section located above and forward of said dispenser, said section having a concave part facing downwards, b) a cutting blade fixed longitudinally within said concave part of said section and having a working profile facing downwards which is shielded on either horizontal side by said concave part, c) a film bar disposed under said dispenser and parallel to said cutting blade, said film bar having a grooved transverse profile and rounded edges facing upwards, and d) a moving means (i) for raising said film bar after said front gripper is moved to extend the film section at the disposed angle in order to engage the film section and move the film section vertically to the second angle so as to be positioned for gripping by said lateral grippers, (ii) for further raising said film bar so that the film section is cut by said cutting blade after wrapping of the article, and (iii) for returning said film bar to a lowered rest position so as not to interfere with said dispenser.

2. A machine for packaging articles as claimed in claim 1, wherein said moving means of said cutting device further includes:

a pair of vertical bars on top of which said film bar is fixed, a fixed support which guides vertical movements of said vertical bars, an electric motor attached to said fixed support, a crank which is rotated by said electric motor and which has an end roller, and a cross piece fixed to said vertical bars and having a straight groove therein in which said end roller is located so that rotation of said crank causes vertical movement of said cross piece, said vertical bars and said film bar.

3. A machine for packaging articles as claimed in claim 2, wherein said moving means of said cutting device further includes:

an appendage extending from said crank beyond said end roller, and a sensor which interacts with said appendage when said moving means moves said film bar to the lowered rest position.

4. A machine for packaging articles as claimed in claim 1, wherein said rounded edge of said film bar closer to said front gripper is vertically higher than said rounded edge further from said gripper and closer to said dispenser.

* * * * *